US007521002B2

(12) United States Patent
Cheng et al.

(10) Patent No.: US 7,521,002 B2
(45) Date of Patent: Apr. 21, 2009

(54) MAGNETORHEOLOGICAL FLUID COMPOSITIONS

(75) Inventors: Yang-Tse Cheng, Rochester Hills, MI (US); John C. Ulicny, Oxford, MI (US); Mark A. Golden, Washington, MI (US); Keith S. Snavely, Sterling Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 365 days.

(21) Appl. No.: 11/201,773

(22) Filed: Aug. 11, 2005

(65) Prior Publication Data

US 2006/0033068 A1 Feb. 16, 2006

Related U.S. Application Data

(60) Provisional application No. 60/601,503, filed on Aug. 13, 2004.

(51) Int. Cl.
*H01F 1/44* (2006.01)

(52) U.S. Cl. ..... 252/62.52

(58) Field of Classification Search ..... 252/62.52
See application file for complete search history.

(56) References Cited

U.S. PATENT DOCUMENTS

| | | | | |
|---|---|---|---|---|
| 5,525,249 | A * | 6/1996 | Kordonsky et al. | 252/62.56 |
| 5,906,767 | A | 5/1999 | Karol et al. | 252/62.52 |
| 6,132,633 | A | 10/2000 | Carlson | 252/65.52 |
| 6,203,717 | B1 | 3/2001 | Munoz et al. | 252/62.52 |
| 6,475,404 | B1 | 11/2002 | Carlson | 252/62.62 |
| 6,547,986 | B1 | 4/2003 | Kintz et al. | 252/62.52 |
| 6,611,185 | B2 | 8/2003 | Carlson et al. | 335/207 |
| 6,695,102 | B1 | 2/2004 | Marjoram et al. | 188/267.2 |
| 2003/0071238 | A1 | 4/2003 | Kintz et al | 252/62.52 |

OTHER PUBLICATIONS

Derwent abstract for CN 1776835, May 24, 2006.*

R.C. Kanu et al; "Effects of DC and AC Electric Fields on the Response of Electrorheological Fluids Conprising Cylindrical PBZT Particles"; Progress in Electrorheology: K.O. Havelka and F.E. Filisko, eds., Plenum, NY, 1995 pp. 303-323.

R.C. Kanu et al; "Studies of ER Fluids Featuring Rodlike Particles"; Int. J. Mod. Phys. B, vol. 10, 2925-2932 (1996).

* cited by examiner

*Primary Examiner*—C. Melissa Koslow

(57) ABSTRACT

A magnetorheological fluid composition comprising a low aspect ratio magnetizable particle comprising a unimodal particle distribution and an aspect ratio less than 1.5, a high aspect ratio magnetizable particle comprising an aspect ratio greater than 1.5, and a carrier fluid.

16 Claims, 3 Drawing Sheets

MAGNETORHEOLOGICAL FLUID COMPOSITIONS

CROSS REFERENCE TO RELATED APPLICATIONS

The present application relates to and claims priority to U.S. Provisional Application No. 60/601,503 filed on Aug. 13, 2004, incorporated herein by reference in its entirety.

BACKGROUND

This disclosure relates to magnetorheological fluid compositions, and more particularly to high yield stress magnetorheological (MR) fluid compositions. The high yield stress fluid compositions include high aspect ratio magnetizable particles and unimodal low aspect ratio magnetizable particles in a carrier fluid.

Fluid compositions that undergo a change in apparent viscosity in the presence of a magnetic field are referred to as Bingham magnetic fluids or magnetorheological fluids. Magnetorheological fluids generally include magnetizable particles dispersed or suspended in a carrier fluid. In the presence of a magnetic field, the magnetizable particles become polarized and are thereby organized into chains of particles or particle fibrils within the carrier fluid. The chains of particles act to increase the apparent viscosity or flow resistance of the fluid composition resulting in the development of a solid mass having a yield stress that must be exceeded to induce onset of flow of the magnetorheological fluid. When the flow of the fluid composition is restricted as a result of orientation of the particles into chains, the fluid composition is said to be in its "on state". The force required to exceed the yield stress is referred to as the "yield strength". In the absence of a magnetic field, the particles return to an unorganized or free state and the apparent viscosity or flow resistance of the fluid composition is then correspondingly reduced. The state occupied by the composition in the absence of a magnetic field is referred to as the "off-state".

Commonly used magnetorheological fluids generally employ magnetizable particles that are symmetrical and have aspect ratios of about 1 to about 1.5. Examples of such particles are spherical particles, ellipsoids, cuboids, or the like. Magnetorheological fluids employing the aforementioned particles are used in devices or systems such as clutches, dampers, actuators, and the like.

In a magnetorheological device, it is often desirable to maximize the ratio of the on-state force to the off-state force in order to maximize the controllability offered by the device. Since the on-state force is dependent upon the magnitude of the applied magnetic field, the on-state force should remain constant at any given applied magnetic field. If the off-state force increases over time because the off-state viscosity is increasing but the on-state force remains constant, the on-state/off-state ratio will decrease. This decrease in the on-state/off-state ratio results in undesirable minimization of the controllability offered by the device. A more durable magnetorheological fluid that does not thicken over an extended period of time, preferably over the life of the device would be very useful.

SUMMARY

Disclosed herein is a low aspect ratio magnetizable particle comprising a unimodal particle distribution and an aspect ratio from 1 to less than 1.5; a high aspect ratio magnetizable particle comprising an aspect ratio greater than 1.5; and a carrier fluid.

The above described and other features are exemplified by the following figures and detailed description.

DETAILED DESCRIPTION

Disclosed herein are magnetorheological (MR) fluid compositions that comprise high aspect ratio magnetizable particles and low aspect ratio magnetizable particles comprising a unimodal particle distribution (i.e., unimodal low aspect ratio magnetizable particles) disposed in a carrier fluid. The high aspect ratio magnetizable particles have an aspect ratio greater than 1.5. As used herein, the term "unimodal" generally refers to a particle distribution that has only one maximum.

The high aspect ratio particles can function as bridges and can contact the chains of the unimodal low aspect ratio particles, thereby increasing the yield stress of the MR fluid composition in the on-state. The high aspect ratio particles contact the low aspect ratio particles or a chain of low aspect ratio particles to create a chain of particles or a network of particles that can increase the apparent viscosity at lower magnetic field strengths when compared with a MR fluid composition that contains only low aspect ratio particles. The increase in viscosity can be advantageously achieved with a smaller number of total magnetizable particles in the high aspect ratio MR fluid composition when compared with a MR fluid composition that contains only low aspect ratio particles. Since the increase in viscosity can be achieved with a smaller number of magnetizable particles, MR devices can be reduced in size when compared with prior art devices.

One advantage of MR fluid compositions is that the yield stress of the MR fluid composition can be 2 to 10 times higher when compared with MR fluid compositions containing low aspect ratio particles alone. This feature, in turn, will allow the production of MR fluid devices that are smaller but produce the same level of force as produced by larger devices that contain MR fluids with only low aspect ratio particles Thus, MR fluids containing high aspect ratio particles and unimodal low aspect ratio magnetizable particles can be used to build devices that are either more powerful and/or smaller than those devices that use MR fluids with only low aspect ratio particles. Also, since high aspect particles will align themselves with the flow field in shear when no magnetic field is present, MR fluid compositions containing the high aspect ratio magnetizable particles will exhibit lower apparent viscosities in the off-state as compared to compositions containing only low aspect ratio particles.

Since fewer magnetizable particles are used in the MR fluid composition, the composition can have a lower viscosity in the off-state, thereby offering a better on-state to off-state ratio and hence greater sensitivity when compared with MR fluid composition that contains only low aspect ratio particles.

Figure 1:
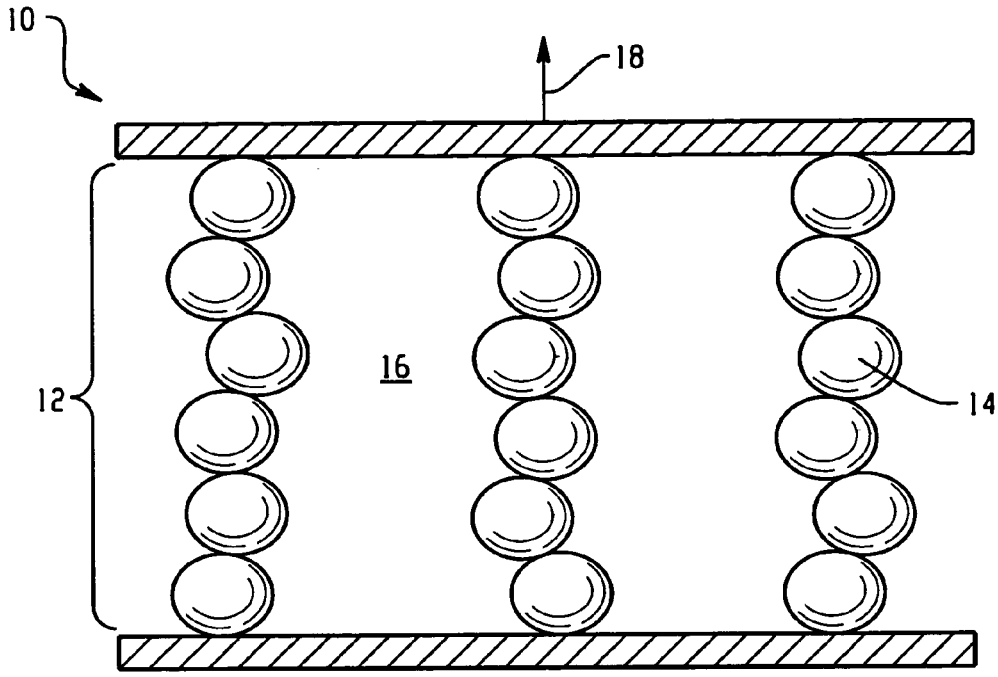
Fig. 1 PRIOR ART
FIG. 1 is a schematic showing low aspect ratio particles that form chains upon the application of a magnetic field.

With reference now to FIG. 1, a prior art MR fluid device 10 contains an MR fluid composition 12 consisting of low aspect ratio particles 14 and a carrier fluid 16. As can be seen in FIG. 1, the low aspect ratio particles 14 form chains in the direction of an applied magnetic field 18. The formation of the chains promotes a selective increase in apparent viscosity, and this increase in viscosity can be used for braking, clutching, shock absorption, damping, mounting, or the like, in vehicles or similar devices, and machinery.

Figure 2:
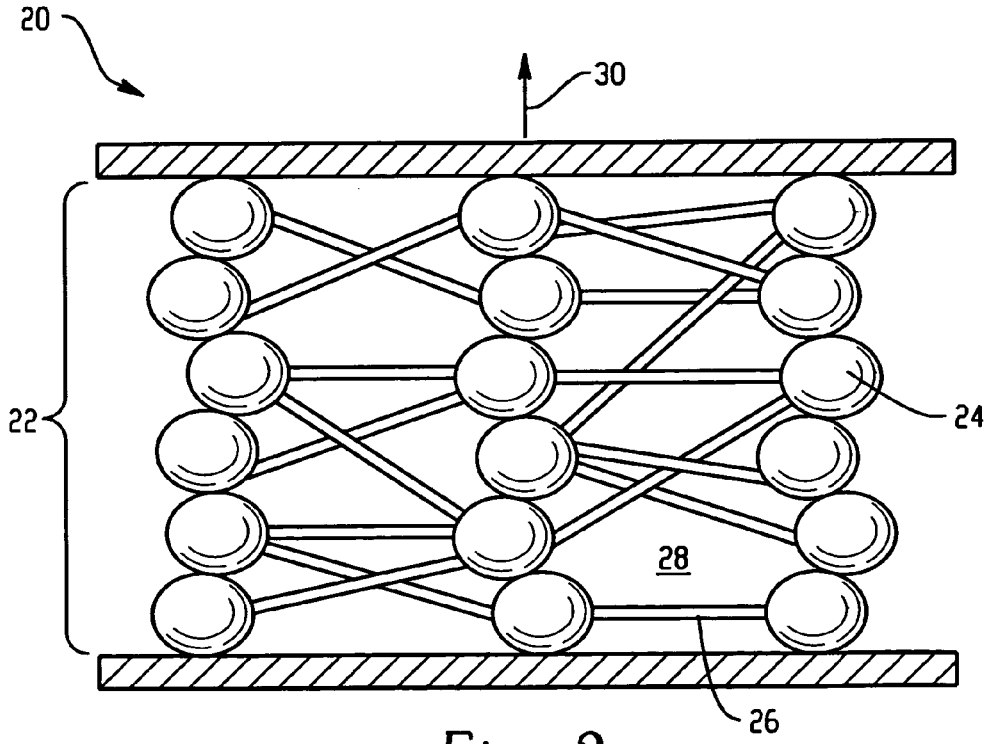
FIG. 2 is a depiction of an exemplary embodiment showing the formation of a network when high aspect ratio particles such as wires are used in conjunction with low aspect ratio particles in a high aspect ratio MR fluid composition.

In FIG. 2, an MR device 20 in accordance with the present disclosure includes an MR fluid composition 22 comprising high aspect ratio magnetizable particles 26 and unimodal low aspect ratio magnetizable particles 24 in a carrier fluid 28. A continuous network is formed when high aspect ratio particles 26 such as wires are used in conjunction with the unimodal low aspect ratio particles 24 and a magnetic field 30 is applied. As can be seen in FIG. 2, the high aspect ratio particles 26 can contact the low aspect ratio particles 24. In one embodiment, the high aspect ratio magnetizable particles have a length that approximates a distance between adjacent columns. In another embodiment, the low aspect ratio magnetizable particle and the high aspect ratio magnetizable particle in the carrier fluid are in an amount effective to form a cross linked pattern, wherein the crosslinked pattern comprises a chain of the low aspect ratio magnetizable particles aligned in a direction of an applied magnetic field and the high aspect ratio magnetizable particles are substantially perpendicular to the applied magnetic field. The formation of a network in FIG. 2 promotes a comparable increase in viscosity as the aligned chains of low aspect ratio magnetizable particles in prior art FIG. 1. However, in FIG. 2 this increase in viscosity can be achieved with the application of a magnetic field of lower strength or intensity.

Figure 3:
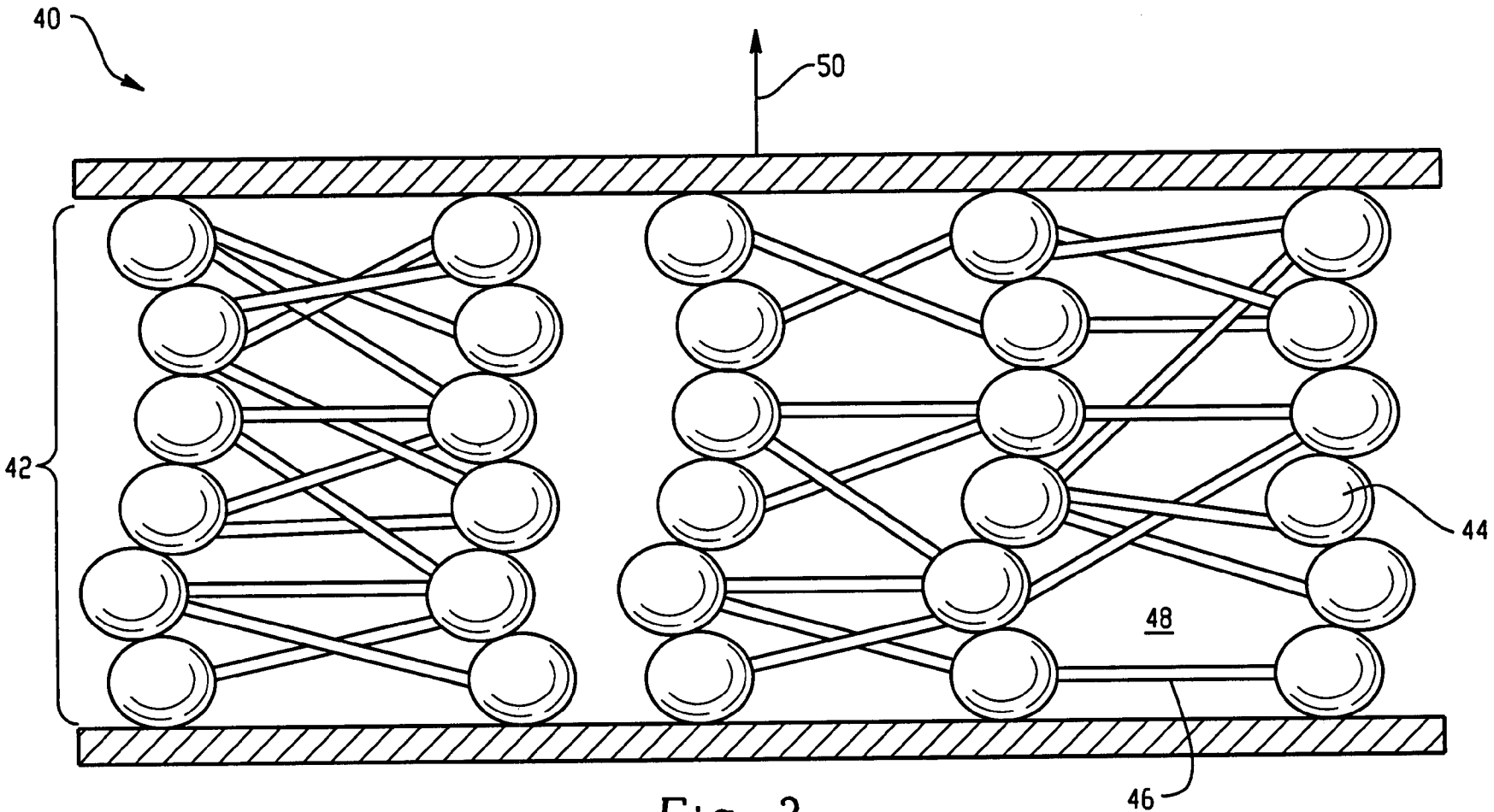
FIG. 3 is a depiction of another exemplary embodiment where the high aspect ratio MR fluid composition form discrete networks of magnetized particles upon the application of the magnetic field.

FIG. 3 depicts a MR device 40 employing a MR composition 42 in accordance with another embodiment. The MR composition 42 includes a plurality of high aspect ratio magnetizable particles 46 and a plurality of unimodal low aspect ratio magnetizable particles 44 disposed in a carrier fluid 48 so as to form multiple discrete networks upon application of an applied field 50. At least one of these discrete networks does not contact an adjacent network when the MR fluid composition is in the on-state.

In FIGS. 2 and 3, the M fluid composition forms a random network upon the application of the magnetic field. However the particles of a high aspect ratio MR fluid composition can also form self-assembled networks that can be used to control the viscosity.

Figure 4:
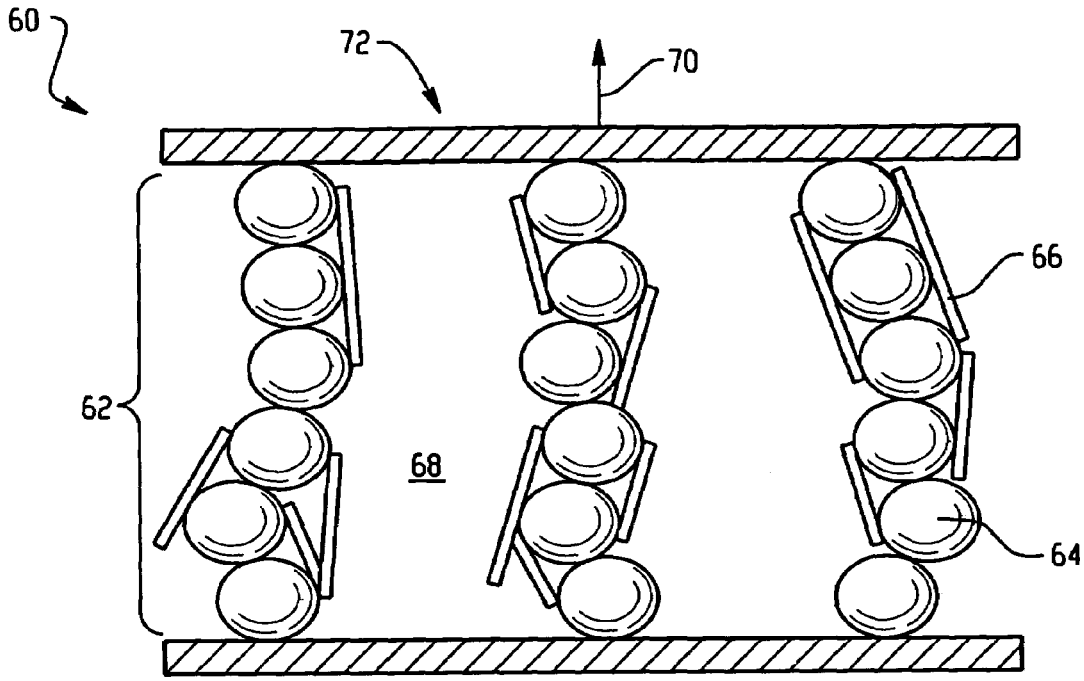
FIG. 4 is a depiction of one exemplary embodiment of a high aspect ratio MR fluid composition wherein the magnetized particles self assemble into columns.

FIG. 4 depicts a MR device 60 employing a MR fluid composition 62 in accordance with another embodiment. The MR composition 62 includes a plurality of high aspect ratio magnetizable particles 66 and a plurality of unimodal low aspect ratio magnetizable particles 64 disposed in a carrier fluid 68 so as to self assemble into columns 72 upon application of an applied field 70. The columns 72 are discrete i.e., they do not contact one another. As shown in FIG. 4, the columns comprise low aspect ratio particles 64 that are contacted and supported by the high aspect ratio particles 66.

In another embodiment, the particles of the high aspect ratio MR fluid composition self assemble into rows instead of columns upon application in the appropriate direction. In yet another embodiment, the particles can self assemble into rows and columns. In one embodiment, the high aspect ratio particles and the low aspect ratio particles can form chains or networks in the on-state, where the high aspect ratio particles can reside in the interstices between the low aspect ratio particles.

Figure 5:
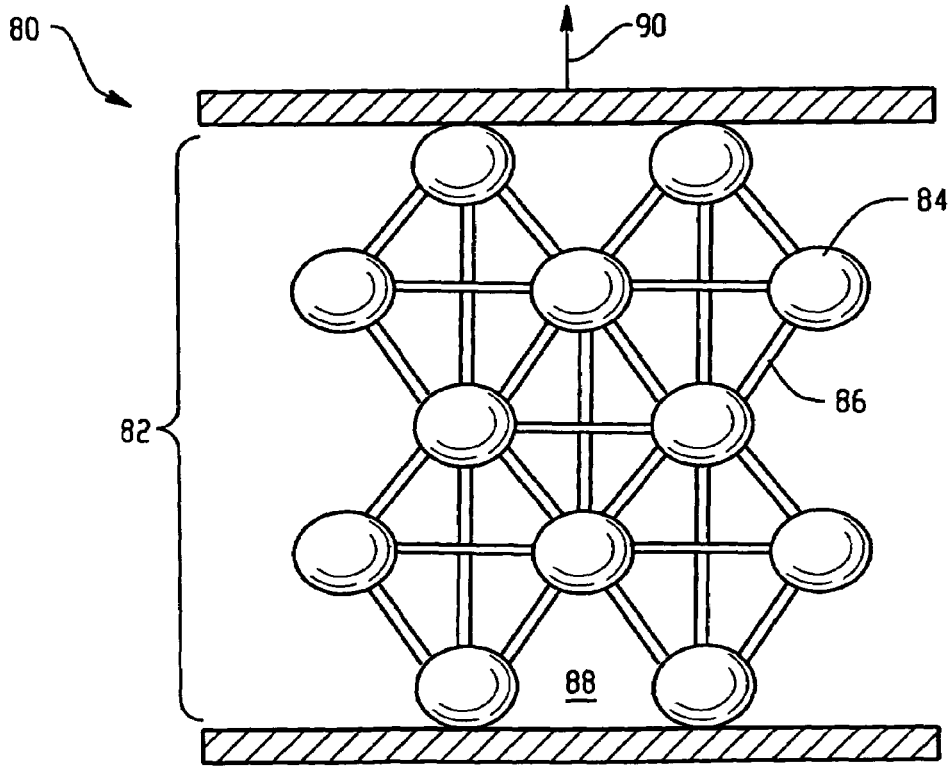
FIG. 5 is a depiction of one exemplary embodiment of a high aspect ratio MR fluid composition wherein the magnetized particles self assemble into rigid three-dimensional structures.

In another embodiment, the high aspect ratio magnetizable particles self assemble into rigid three-dimensional structures as depicted in the FIG. 5. In FIG. 5, the MR device 80 includes an MR composition 82 comprising a plurality of high aspect ratio magnetizable particles 86 and a plurality of unimodal low aspect ratio magnetizable particles 84 disposed in a carrier fluid 88 so as to self assemble into the three dimensional rigid structure upon application of an applied field 90. The formation of such structures can lead to enhanced strength and high viscosities at low magnetic field strengths.

The magnetizable particles of the MR fluid composition are comprised of, for example, paramagnetic, superparamagnetic, ferromagnetic compounds, or a combination comprising at least one of the foregoing compounds. Examples of specific magnetizable particles are particles comprised of materials such as iron, iron oxide, iron nitride, iron carbide, carbonyl iron, chromium dioxide, low carbon steel, silicon steel, nickel, cobalt, or the like, or a combination comprising at least one of the foregoing. The iron oxide includes all forms of pure iron oxide, such as, for example, $Fe_2O_3$ and $Fe_3O_4$, as well as those containing small amounts of other elements, such as, manganese, zinc or barium. Specific examples of iron oxide include ferrites and magnetites. In addition, the magnetizable particles can be comprised of alloys of iron, such as, for example, those containing aluminum, silicon, cobalt, nickel, vanadium, molybdenum, chromium, tungsten, manganese, copper, or a combination comprising at least one of the foregoing metals.

The magnetizable component can also be comprised of the specific iron-cobalt and iron-nickel alloys. The iron-cobalt alloys have an iron to cobalt ratio ranging from about 30:70 to about 95:5. In one embodiment, the iron-cobalt alloys can have an iron to cobalt ratio ranging from about 50:50 to about 85:15. The iron-nickel alloys have an iron to nickel ratio ranging from about 90:10 to about 99:1. In one embodiment, the iron-nickel alloys can have an iron to cobalt ratio ranging from about 94:6 to about 97:3. The aforementioned iron-cobalt and iron-nickel alloys may also contain a small amount of additional elements, such as, for example, vanadium, chromium, or the like, in order to improve the ductility and mechanical properties of the alloys.

In still another embodiment, the magnetizable component can be comprised of non-magnetic ceramic and polymeric fibers that include coatings of a magnetic material or a magnetic material attached thereto.

These additional elements are typically present in an amount that is less than about 3.0% by weight, based on the total weight of the magnetizable particles.

The magnetizable particles are generally obtained from processes involving the reduction of metal oxides, grinding or attrition, electrolytic deposition, metal carbonyl decomposition, rapid solidification, or smelt processing. Examples of suitable metal powders that are commercially available are straight iron powders, reduced iron powders, insulated reduced iron powders, cobalt powders, or the like, or a combination comprising at least one of the foregoing metal powders. Alloy powders can also be used. A suitable example of an alloy powder is one comprising 48 wt % iron, 50 wt % cobalt and 2 wt % vanadium from UltraFine Powder Technologies.

Exemplary magnetizable particles are those that contain a majority of iron in any one of its chemically available forms.

Carbonyl iron powders that are made by the thermal decomposition of iron pentacarbonyl are generally desirable for use in a high aspect ratio MR fluid composition.

The magnetizable particles that have a unimodal low aspect ratio generally have an aspect ratio of about 1 to 1.5. An exemplary low aspect ratio particle is one that has an aspect ratio of about 1. Examples of suitable low aspect ratio particles are spherical, ellipsoidal, conical, cuboidal, polygonal, or the like. The magnetizable particles that have a low aspect ratio generally have an average particle size of about 0.1 micrometers to about 500 micrometers. In one embodiment, the magnetizable particles that have a spherical shape generally have an average particle size of about 1 micrometers to about 250 micrometers. In another embodiment, the magnetizable particles that have a spherical shape generally have an average particle size of about 10 micrometers to about 100 micrometers. In yet another embodiment, the magnetizable particles that have a spherical shape generally have an average particle size of about 20 micrometers to about 80 micrometers.

The high aspect ratio magnetizable particles are those having an aspect ratio of greater than 1.5. These high aspect ratio magnetizable particles may therefore exist in the form of whiskers, needles, rods, tubes, strands, elongated platelets, lamellar platelets, ellipsoids, wires, micro fibers, nanofibers and nanotubes, elongated fullerenes, or the like, or a combination comprising at least one of the foregoing.

In general, the high aspect ratio magnetizable particles can have cross sections that have any desirable geometry. Examples of suitable geometries are square, rectangular, triangular, circular, elliptical, polygonal, or a combination comprising at least one of the foregoing geometries.

The high aspect ratio particles can be nanoparticles or particles having dimensions in the micrometer range. High aspect ratio nanoparticles are those having at least one average dimension that is less than or equal to about 1,000 nanometers. A suitable example of a nanoparticle is one having an average diameter size of less than or equal to about 500 nanometers. In one embodiment, it is desirable for the high aspect ratio nanoparticles to have at least one average dimension that is less than or equal to about 200 nanometers. In another embodiment, it is desirable for the high aspect ratio nanoparticles to have at least one average dimension that is less than or equal to about 100 nanometers. In yet another embodiment, it is desirable for the high aspect ratio nanoparticles to have at least one average dimension that is less than or equal to about 25 nanometers.

Micrometer sized high aspect ratio magnetizable particles are those having the smallest dimension greater than about 1 micrometer. In one embodiment, micrometer sized high aspect ratio magnetizable particles are those having the smallest dimension greater than or equal to about 10 micrometers. In another embodiment, micrometer sized high aspect ratio magnetizable particles are those having the smallest dimension greater than or equal to about 100 micrometers. In yet another embodiment, micrometer sized high aspect ratio magnetizable particles are those having the smallest dimension greater than or equal to about 1,000 micrometers.

The aspect ratio of the high aspect ratio magnetizable particles is greater than 1.5. In one embodiment, the aspect ratio of the high aspect ratio magnetizable particles is greater than 20. In another embodiment, the aspect ratio of the high aspect ratio magnetizable particles is greater than 100. In yet another embodiment, the aspect ratio of the high aspect ratio magnetizable particles is greater than 1,000. In yet another embodiment, the aspect ratio of the high aspect ratio magnetizable particles is greater than 10,000.

The weight ratio of the high aspect ratio magnetizable particles to the low aspect ratio magnetizable particles is about 100:1 to about 1:100. In one embodiment, the weight ratio of the high aspect ratio magnetizable particles to the low aspect ratio magnetizable particles is about 75:1 to about 1:75. In another embodiment, the weight ratio of the high aspect ratio magnetizable particles to the low aspect ratio magnetizable particles is about 50:1 to about 1:50. In yet another embodiment, the weight ratio of the high aspect ratio magnetizable particles to the low aspect ratio magnetizable particles is about 25:1 to about 1:25. An exemplary weight ratio of the high aspect ratio magnetizable particles to the low aspect ratio magnetizable particles is about 1.4.

The number of magnetizable particles in the high aspect ratio MR fluid composition depends upon the desired magnetic activity and viscosity of the fluid, but can be from about 5 to about 60 volume percent, based on the total volume of the high aspect ratio MR fluid composition. In one embodiment, the number of magnetizable particles in the high aspect ratio MR fluid composition can be from about 15 to about 50 volume percent, based on the total volume of the high aspect ratio MR fluid composition.

The carrier fluid forms the continuous phase of the MR fluid composition. Examples of suitable carrier fluids are natural fatty oils, mineral oils, poly α-olefins, polyphenylethers, polyesters (such as perfluorinated polyesters, dibasic acid esters and neopentylpolyol esters), phosphate esters, synthetic cycloparaffin oils and synthetic paraffin oils, unsaturated hydrocarbon oils, monobasic acid esters, glycol esters and ethers (such as polyalkylene glycol), synthetic hydrocarbon oils, perfluorinated polyethers, halogenated hydrocarbons, or the like, or a combination comprising at least one of the foregoing carrier fluids.

Exemplary carrier fluids are those which are non-volatile, non-polar and do not contain amounts of water greater than or equal to about 5 wt %, based upon the total weight of the carrier fluid. Examples of hydrocarbons are mineral oils, paraffins, or cycloparaffins. Synthetic hydrocarbon oils include those oils derived from oligomerization of olefins such as polybutenes and oils derived from high molecular weight alpha olefins having about 8 to about 20 carbon atoms by acid catalyzed dimerization and by oligomerization using trialuminum alkyls as catalysts.

The carrier fluid is generally present in an amount of about 40 to about 95 volume percent, based upon the total volume of high aspect ratio MR fluid composition. In one embodiment, the carrier fluid is generally present in an amount ranging from about 65 to about 80 volume percent, based upon the total volume of the MR fluid composition.

The MR fluid composition can optionally include other additives such as a thixotropic agent, a carboxylate soap, an antioxidant, a lubricant, a viscosity modifier, a sulfur-containing compound or a combination comprising at least one of the foregoing additives. If present, these optional additives can be present in an amount of about 0.25 to about 10 volume percent, based upon the total volume of the magnetorheological fluid. In one embodiment, these optional additives can be present in an amount of about 0.5 to about 7.5 volume percent, based upon the total volume of the magnetorheological fluid.

Exemplary thixotropic agents include polymer-modified metal oxides. The polymer-modified metal oxide can be prepared by reacting a metal oxide powder with a polymeric compound that is compatible with the carrier fluid and capable of shielding substantially all of the hydrogen-bonding sites or groups on the surface of the metal oxide from any interaction with other molecules. Examples of suitable metal oxide powders include precipitated silica gel, fumed or pyrogenic silica, silica gel, titanium dioxide, and iron oxides such as ferrites or magnetites, or the like, or a combination comprising at least one of the foregoing metal oxide powders. Additional exemplary thixotropic agents include clays. The term "clay" as used herein is defined to mean a naturally and/or synthetically derived composition composed mainly of hydrous metal silicates. It is to be understood that the clay-based suspending agent may be divided into particles that may be readily integrated into the embodiment of the carrier fluid employed. Non-limitative examples of suitable clay-based suspending agents include organically modified bentonite or montmorillonite clays modified with alkyl quaternary ammonium and/or phosphonium compounds.

Examples of suitable polymeric compounds useful in forming the polymer-modified metal oxides include thermosetting polymers, thermoplastic polymers or combinations of thermosetting polymers with thermoplastic polymers. Examples of polymeric compounds are oligomers, polymers, copolymers such as block copolymers, star block copolymers, terpolymers, random copolymers, alternating copolymers, graft copolymers, or the like, dendrimers, ionomers, or the like, or a combination comprising at least one of the foregoing. Examples of suitable polymers are polyacetals, polysiloxanes, polyurethanes, polyolefins, polyacrylics, polycarbonates, polyalkyds, polystyrenes, polyesters, polyamides, polyaramides, polyamideimides, polyarylates, polyarylsulfones, polyethersulfones, polyphenylene sulfides, polysulfones, polyimides, polyetherimides, polytetrafluoroethylenes, polyetherketones, polyether etherketones, polyether ketone ketones, polybenzoxazoles, polyoxadiazoles, polybenzothiazinophenothiazines, polybenzothiazoles, polypyrazinoquinoxalines, polypyromellitimides, polyquinoxalines, polybenzimidazoles, polyoxindoles, polyoxoisoindolines, polydioxoisoindolines, polytriazines, polypyridazines, polypiperazines, polypyridines, polypiperidines, polytriazoles, polypyrazoles, polycarboranes, polyoxabicyclononanes, polydibenzofurans, polyphthalides, polyacetals, polyanhydrides, polyvinyl ethers, polyvinyl thioethers, polyvinyl alcohols, polyvinyl ketones, polyvinyl halides, polyvinyl nitriles, polyvinyl esters, polysulfonates, polysulfides, polythioesters, polysulfones, polysulfonamides, polyureas, polyphosphazenes, polysilazanes, polysiloxanes, phenolics, epoxies, or combinations comprising at least one of the foregoing organic polymers.

A polymer-modified metal oxide, in the form of fumed silica treated with a siloxane oligomer can also be used as an additive.

Examples of the carboxylate soap include lithium stearate, calcium stearate, aluminum stearate, ferrous oleate, ferrous stearate, zinc stearate, sodium stearate, strontium stearate, or the like, or a combination comprising at least one of the foregoing carboxylate soaps.

Examples of sulfur-containing compounds include thioesters such as tetrakis thioglycolate, tetrakis(3-mercaptopropionyl) pentaerithritol, ethylene glycoldimercaptoacetate, 1,2,6-hexanetriol trithioglycolate, trimethylol ethane tri(3-mercaptopropionate), glycoldimercaptopropionate, bisthioglycolate, trimethylolethane trithioglycolate, trimethylolpropane tris(3-mercaptopropionate) and similar compounds and thiols such as 1-dodecylthiol, 1-decanethiol, 1-methyl-1-decanethiol, 2-methyl-2-decanethiol, 1-hexadecylthiol, 2-propyl-2-decanethiol, 1-butylthiol, 2-hexadecylthiol, or the like, or a combination comprising at least one of the foregoing sulfur-containing compounds The viscosity of the MR fluid composition is dependent upon the specific use to which it is applied. In general, it is desirable for the MR fluid composition to have a viscosity of about 1 to about 1000 Pascal-seconds at 40° C. in the off-state. In one embodiment, it is desirable for the MR fluid composition to have a viscosity of about 10 to about 700 Pascal-seconds at 40° C. in the off-state. In yet another embodiment, it is desirable for the MR fluid composition to have a viscosity of about 50 to about 600 Pascal-seconds at 40° C. in the off-state. In yet another embodiment, it is desirable for the MR fluid composition to have a viscosity of about 90 to about 400 Pascal-seconds at 40° C. in the off-state.

In general, it is desirable for the MR fluid composition to have an apparent viscosity of about 2 to about 10 times the viscosity of a prior art MR fluid composition that contains only low aspect ratio particles, when in the on-state at 40° C. In one embodiment, it is desirable for the MR fluid composition to have a viscosity of about 3 to about 8 times the viscosity of the prior art MR fluid composition that contains only low aspect ratio particles, when in the on-state at 40° C. In one embodiment, it is desirable for the MR fluid composition to have a viscosity of about 4 to about 7 times the viscosity of the prior art MR fluid composition that contains only low aspect ratio particles, when in the on-state at 40° C.

A method of manufacturing the high aspect ratio MR fluid composition includes mixing the unimodal low aspect ratio particles, the high aspect ratio particles, the carrier fluid and desired additives in a suitable mixing device to form a suitable mixture. If desired, mixing may be conducted at an elevated temperature of greater than or equal to about 50° C. The mixing can take place in a device that uses shear force, extensional force, compressive force, ultrasonic energy, electromagnetic energy, thermal energy or combinations comprising at least one of the foregoing forces and energies and is conducted in processing equipment wherein the aforementioned forces are exerted by a single screw, multiple screws, intermeshing co-rotating or counter rotating screws, non-intermeshing co-rotating or counter rotating screws, reciprocating screws, screws with pins, barrels with pins, screen packs, rolls, rams, helical rotors, or combinations comprising at least one of the foregoing.

Exemplary mixing devices are extruders such as single screw and twin screw extruders, buss kneaders, helicones, Eirich mixers, Waring blenders, Henschel mixers, ball mills or the like.

In one embodiment related to the use of the high aspect ratio magnetorheological fluid, a method of increasing a yield stress of a MR composition comprises mixing the high aspect ratio magnetizable particles with the unimodal low aspect magnetizable particles in a suitable carrier fluid to form the MR fluid composition. Applying a magnetic field to the MR fluid composition polarizes the high aspect ratio and low aspect ratio magnetizable particles to align and form a chain. As detailed above, the aligning promotes the formation of a network of interconnected chains. The polarizing and aligning of the high aspect ratio and low aspect ratio magnetizable particles promotes an increase in viscosity. It is desirable for the increase in viscosity in the on-state to be at least 100% greater than the viscosity in the off-state.

The magnetorheological fluid can be advantageously used in any controllable device such as dampers, mounts, clutches, brakes, valves and similar devices. These magnetorheological devices include a housing or chamber that contains the magnetorheological fluid. The fluid is particularly suitable for use in devices that require exceptional durability such as dampers and clutches.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the invention not be limited to the particular embodiment disclosed as the best mode contemplated for carrying out this disclosure.

What is claimed is:

1. A magnetorheological fluid composition, comprising:

a low aspect ratio magnetizable particle comprising a unimodal particle distribution and an aspect ratio from 1 to less than 1.5;

a high aspect ratio magnetizable particle comprising an aspect ratio greater than 1.5, wherein the high aspect ratio magnetizable particles have a smallest dimension greater than about 1 micrometer; and a carrier fluid.

2. The composition of claim 1, wherein the low aspect ratio magnetizable particles are spherical, ellipsoidal, conical, cuboidal, or polygonal.

3. The composition of claim 1, wherein the low aspect ratio magnetizable particles have an average particle size of about 0.1 micrometers to about 500 micrometers.

4. The composition of claim 1, wherein the high aspect ratio magnetizable particles comprise whiskers, needles, rods, tubes, strands, elongated platelets, lamellar platelets, ellipsoids, wires, micro fibers, nanofibers, nanotubes, elongated fullerenes, or a combination comprising at least one of the foregoing.

5. The composition of claim 1, wherein the high aspect ratio magnetizable particles comprise cross sectional geometries that are square, rectangular, triangular, circular, elliptical, polygonal, or a combination comprising at least one of the foregoing geometries.

6. The composition of claim 1, wherein the high aspect ratio magnetizable particles comprise nanoparticles that have at least one average dimension less than or equal to about 1,000 nanometers.

7. The composition of claim 1, wherein the low aspect ratio magnetizable particle and the high aspect ratio magnetizable particle in the carrier fluid are in an amount effective to form discrete columns upon application of an applied field transverse to a flow direction of the fluid composition.

8. The composition of claim 1, wherein the high aspect ratio magnetizable particles and the low aspect ratio magnetizable particles are manufactured from iron, iron oxide, iron nitride, iron carbide, carbonyl iron, chromium dioxide, low carbon steel, silicon steel, nickel, cobalt, iron oxides that contain small amounts of manganese, zinc or barium; alloys of iron that contain aluminum, silicon, cobalt, nickel, vanadium, molybdenum, chromium, tungsten, manganese, copper, or a combination comprising at least one of the foregoing metals; iron-cobalt alloys having an iron to cobalt ratio ranging from about 30:70 to about 95:5; iron-nickel alloys having an iron to nickel ratio ranging from about 90:10 to about 99:1; or a combination comprising at least one of the foregoing.

9. The composition of claim 1, wherein the weight ratio of the high aspect ratio magnetizable particles to the low aspect ratio magnetizable particles is about 1:100 to about 100:1.

10. The composition of claim 1, wherein the carrier fluid is at about 40 to about 95 volume percent based upon the total volume of the magnetorheological fluid composition.

11. The composition of claim 1, wherein the composition has a viscosity of about 1 to about 1,000 Pascal-seconds at 40° C. in an off-state.

12. The composition of claim 1, wherein the composition has an on state viscosity of about 2 to about 10 times that of a second magnetorheological fluid composition that consists of low aspect ratio particles.

13. The composition of claim 1, wherein the low aspect ratio magnetizable particle and the high aspect ratio magnetizable particle in the carrier fluid are in an amount effective to form a cross linked pattern, wherein the crosslinked pattern comprises a chain of the low aspect ratio magnetizable particles aligned in a direction of an applied magnetic field and the high aspect ratio magnetizable particles are substantially perpendicular to the applied magnetic field.

14. The composition of claim 1, wherein the low aspect ratio magnetizable particle and the high aspect ratio magnetizable particle in the carrier fluid are in an amount effective to form a three dimensional rigid structure.

15. The composition of claim 7, wherein the high aspect ratio magnetizable particles have a length that approximates a distance between adjacent columns.

16. The composition of claim 1, wherein the low aspect ratio magnetizable particle is spherical and has an aspect ratio of about 1.

* * * * *